US009803351B2

(12) United States Patent
Ledford

(10) Patent No.: US 9,803,351 B2
(45) Date of Patent: Oct. 31, 2017

(54) ROLL FORM FRAMING SYSTEM

(71) Applicant: Gary Alan Ledford, Florissant, CO (US)

(72) Inventor: Gary Alan Ledford, Florissant, CO (US)

( * ) Notice: Subject to any disclaimer, the term of this patent is extended or adjusted under 35 U.S.C. 154(b) by 0 days.

(21) Appl. No.: 15/334,123

(22) Filed: Oct. 25, 2016

(65) Prior Publication Data

US 2017/0121960 A1 May 4, 2017

Related U.S. Application Data

(60) Provisional application No. 62/247,262, filed on Oct. 28, 2015.

(51) Int. Cl.
*E04B 1/24* (2006.01)
*E04B 2/60* (2006.01)

(52) U.S. Cl.
CPC ..... *E04B 1/2403* (2013.01); *E04B 2/60* (2013.01); *E04B 2001/2421* (2013.01); *E04B 2001/2448* (2013.01); *E04B 2001/2457* (2013.01); *E04B 2001/2466* (2013.01); *E04B 2103/06* (2013.01)

(58) Field of Classification Search
CPC .. E04B 1/2403; E04B 2/60; E04B 2001/2448; E04B 2001/2457; E04B 2001/2415; E04B 1/5806; E04B 1/5818; E04B 2103/06; E04B 2001/2466; E04B 2001/2421
See application file for complete search history.

(56) References Cited

U.S. PATENT DOCUMENTS 3,119,635 A * 1/1964 Dealy ..... E02D 5/523 403/334
3,255,769 A * 6/1966 Lloyd ..... A01G 9/14 135/138
3,429,602 A * 2/1969 Dirilgen ..... E04B 1/2403 403/295
4,464,074 A * 8/1984 Green ..... E04B 1/2403 211/182
4,616,453 A * 10/1986 Sheppard, Jr. ..... E04C 3/07 52/478
4,841,688 A * 6/1989 Rinaldi ..... E04H 15/322 52/63
8,695,290 B1 * 4/2014 Kim ..... F24J 2/5252 248/225.11

(Continued)

*Primary Examiner* — Adriana Figueroa
*Assistant Examiner* — Jessie T Fonseca

(57) ABSTRACT

A roll form framing system has a plurality of support beams being interconnected by a plurality of couplers and a plurality of splines. Each of the plurality of support beams including a beam body, a first structural channel, and a second structural channel. The first structural channel and the second structural channel are formed into an outer lateral wall of the beam body, wherein the first structural channel and the second structural channel provide a recess for aligning a plurality of fasteners utilized to secure the plurality of support beams, the plurality of couplers, and the plurality of splines to each other. The outer lateral wall and an inner lateral wall of the beam body delineate a coupler receiving volume for accepting one of the plurality of couplers, while the inner lateral wall delineates a spline receiving volume for accepting one of the plurality of splines.

15 Claims, 11 Drawing Sheets

(56) References Cited

U.S. PATENT DOCUMENTS

| | | | | |
|---|---|---|---|---|
| 2003/0089069 | A1* | 5/2003 | Babich | E04B 1/2403 52/693 |
| 2005/0084324 | A1* | 4/2005 | Dubensky | E04B 1/3483 403/305 |
| 2008/0060876 | A1* | 3/2008 | Henderson | E04B 1/2403 182/186.8 |
| 2008/0190068 | A1* | 8/2008 | Tapscott | E04B 1/2403 52/690 |
| 2013/0167465 | A1* | 7/2013 | Santeramo | E04B 9/068 52/506.07 |
| 2014/0112711 | A1* | 4/2014 | Hertweck | E04B 9/10 403/297 |
| 2014/0123587 | A1* | 5/2014 | Lee | E04B 1/24 52/655.1 |
| 2014/0130441 | A1* | 5/2014 | Sugihara | E04B 1/2403 52/656.9 |
| 2014/0237920 | A1* | 8/2014 | Burgess | E04C 3/40 52/223.14 |

* cited by examiner

ROLL FORM FRAMING SYSTEM

The current application claims a priority to the U.S. Provisional Patent application Ser. No. 62/247,262 filed on Oct. 28, 2015.

FIELD OF THE INVENTION

The present invention relates generally to modular construction systems. More specifically, the present invention is a roll form framing system for the construction of truss assemblies, walls, roofs, interior and exterior partitions for structurally supporting assemblies, etc.

BACKGROUND OF THE INVENTION

Millions of homes are lost worldwide each year due to natural disasters and other catastrophic events. Disasters such as earthquakes, hurricanes, tsunamis, etc. affect thousands of people at a time, dislocating many to temporary housing. Rebuilding efforts are installed shortly after such disasters, in an effort to provide housing to displaced individuals and restore the area to pre-disaster form. However, such rebuilding efforts can often take much longer than anticipated, due in part to both money, materials available, and the time it takes to construct a housing unit. As a result, disaster victims are often displaced from their homes for extended periods of times, being forced to rely on the hospitality of others to survive. A modular construction system for quickly and affordably providing housing is needed in order to provide better relief to disaster victims, and other displaced individuals worldwide.

Therefore it is an object of the present invention to provide a roll form frame system that can be utilized to form truss assemblies, wall, roofs, and interior and exterior partitions related to structural supporting assemblies. The present invention includes a plurality of support beams, a plurality of couplers, and a plurality of splines. Each of the plurality of support beams has a beam body, a first structural channel, and a second structural channel; the beam body having an outer lateral wall and an inner lateral wall. Each of the support beams is designed to receive one of the plurality of couplers and/or one of the plurality of splines, wherein the plurality of couplers and the plurality of splines interconnects the plurality of support beams to each other. The plurality of support beams, the plurality of couplers, and the plurality of splines are roll formed, ensuring consistency among components, and providing an efficient manufacture process. Furthermore, each of the plurality of support beams is structurally stronger than a c-channel, as each of the plurality of support beams folds in on itself.

DETAIL DESCRIPTIONS OF THE INVENTION

All illustrations of the drawings are for the purpose of describing selected versions of the present invention and are not intended to limit the scope of the present invention.

The present invention is a roll form farming system for the construction of truss assemblies, walls, roofs, interior and exterior partitions for structurally supporting assemblies, etc. The present invention comprises a plurality of support beams 1, a plurality of couplers 2, a plurality of splines 3, and a plurality of fasteners 4 that can be configured to form a variety of structures. Together, the plurality of couplers 2 and the plurality of splines 3 are utilized to interconnect the plurality of support beams 1 in order to form the desired structure.

Figure 1:
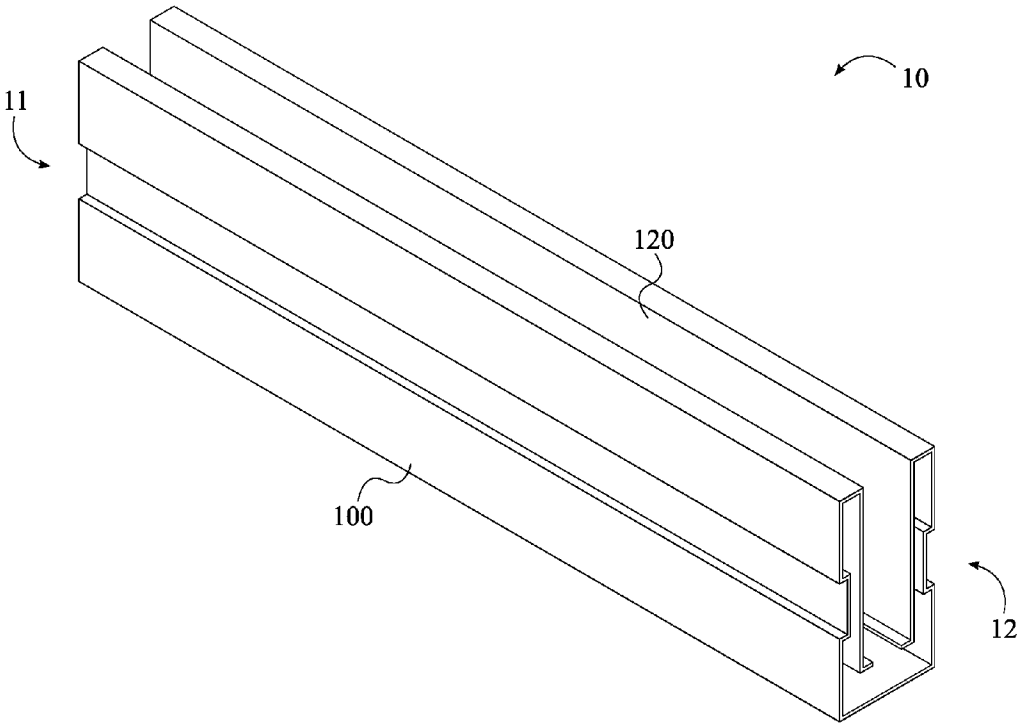
FIG. 1 is a perspective view of one of the plurality of support beams.

In reference to FIG. 1, each of the plurality of support beams 1 comprises a beam body 10, a first structural channel 11, and a second structural channel 12. The beam body 10 is an elongated, thin-walled member that is utilized to form the framework of the desired structure, while the first structural channel 11 and the second structural channel 12 provide junctures for installing the plurality of fasteners 4. In the preferred embodiment of the present invention, the beam body 10 of each of the plurality of support beams 1 is roll formed from steel, however, different materials and methods of formation may be used in other embodiments.

Figure 2:
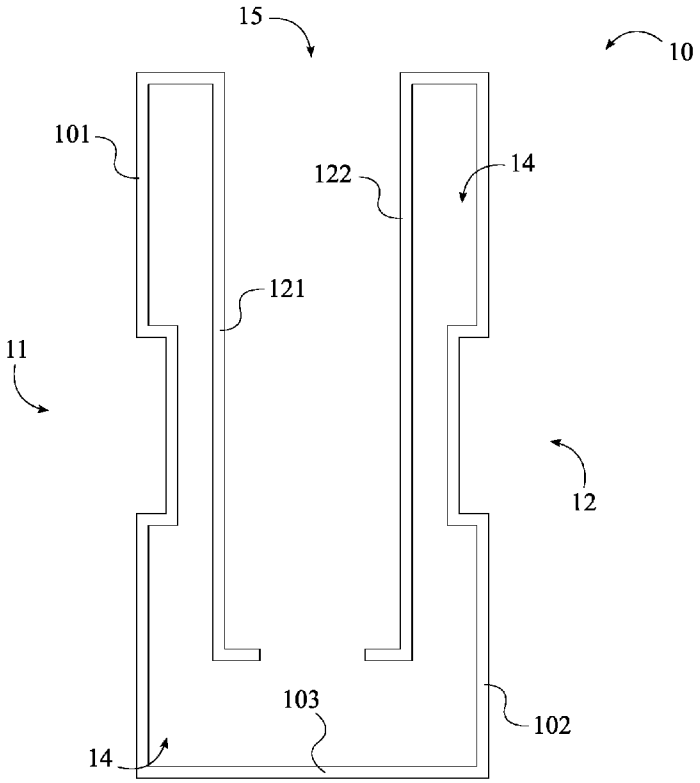
FIG. 2 is a right side elevational view thereof.

In reference to FIG. 1-2, the beam body 10 is a hollow structure, comprising an outer lateral wall 100 and an inner lateral wall 120, wherein the first structural channel 11 and the second structural channel 12 are formed into the outer lateral wall 100. The first structural channel 11 and the second structural channel 12 run along the length of the beam body 10, allowing for the installation of the plurality of fasteners 4 anywhere along the length of the beam body 10. Furthermore, the first structural channel 11 and the second structural channel 12 are positioned opposite each other across the beam body 10, such that the plurality of fasteners 4 can be installed from either side of the beam body 10.

In reference to FIG. 2, the beam body 10 has a U-shaped cross section that is formed by the outer lateral wall 100 and the inner lateral wall 120. The outer lateral wall 100 comprises a first outer-lateral wall 101, a second outer-lateral wall 102, and a third outer-lateral wall 103, while the inner lateral wall 120 comprises a first inner-lateral wall 121 and a second inner-lateral wall 122. The first outer-lateral wall 101 and second outer-lateral wall 102 are terminally connected to the third outer-lateral wall 103, wherein the third outer-lateral wall 103 forms the bottom of the U-shape; the first outer-lateral wall 101 and the second outer-lateral wall 102 being parallel to each other and perpendicular to the third outer-lateral wall 103.

The first structural channel 11 is formed into the first outer-lateral wall 101, while the second structural channel 12 is formed into the second outer-lateral wall 102; the first structural channel 11 and the second structural channel 12 being positioned parallel to each other. Furthermore, the second structural channel 12 is mirrored from the first structural channel 11. In this way, the plurality of fasteners 4 traverse from the first structural channel 11 to the second structural channel 12, or vice versa, when each of the plurality of fasteners 4 is installed.

Figure 5:
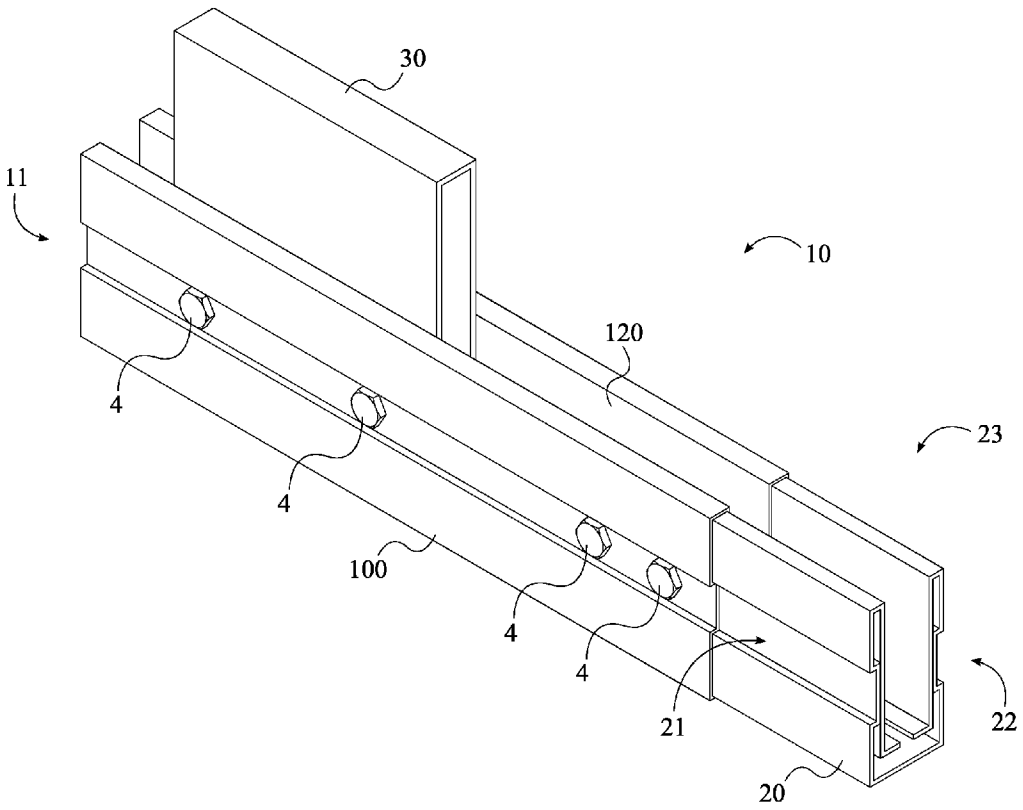
FIG. 5 is a perspective view, wherein an arbitrary coupler and an arbitrary spline are connected to a support beam using a plurality of fasteners.
Figure 6:
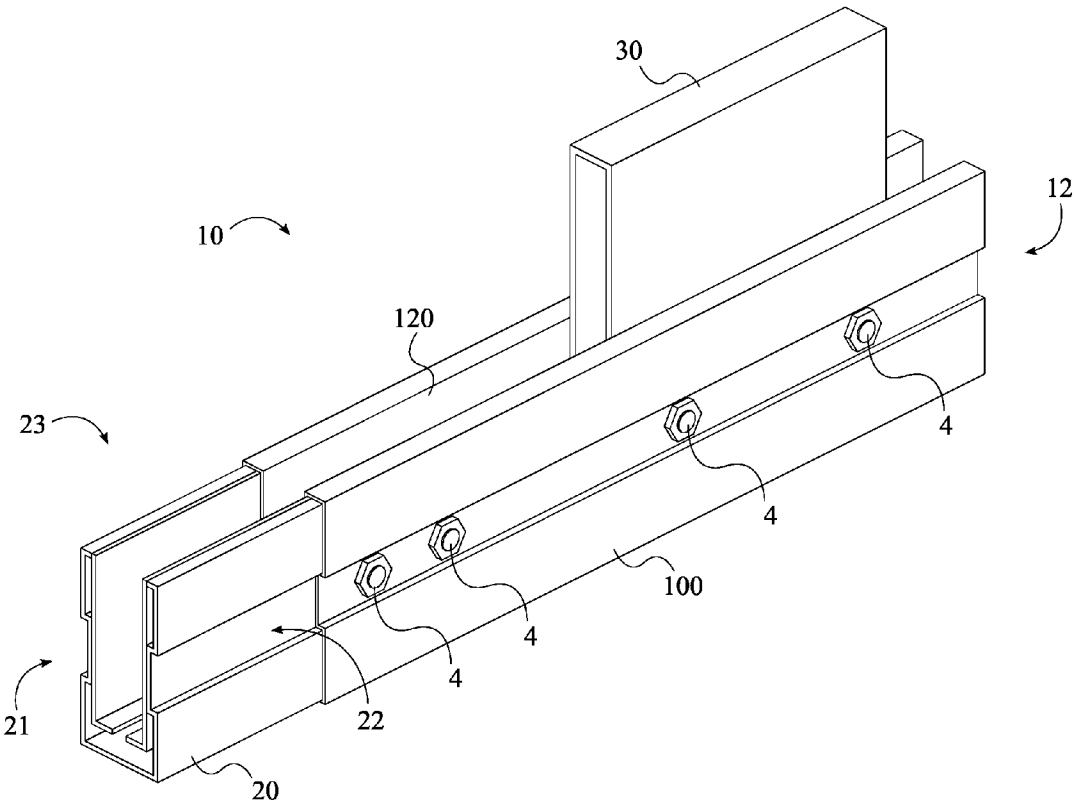
FIG. 6 is a rear perspective view thereof.

In reference to FIG. 2, the first inner-lateral wall 121 corresponds and is parallel to the first outer-lateral wall 101, while the second inner-lateral wall 122 corresponds and is parallel to the second outer-lateral wall 102; the first inner-lateral wall 121 and the second inner-lateral wall 122 being positioned in between the first outer-lateral wall 101 and the second outer-lateral wall 102. Together, the outer lateral wall 100 and the inner lateral wall 120 delineate a coupler receiving volume 14 for accepting one of the plurality of couplers 2, as depicted in FIG. 5-6. Meanwhile, the inner lateral wall 120 delineates a spline receiving volume 15 for accepting one of the plurality of splines 3, as depicted in FIG. 5-6.

Figure 3:
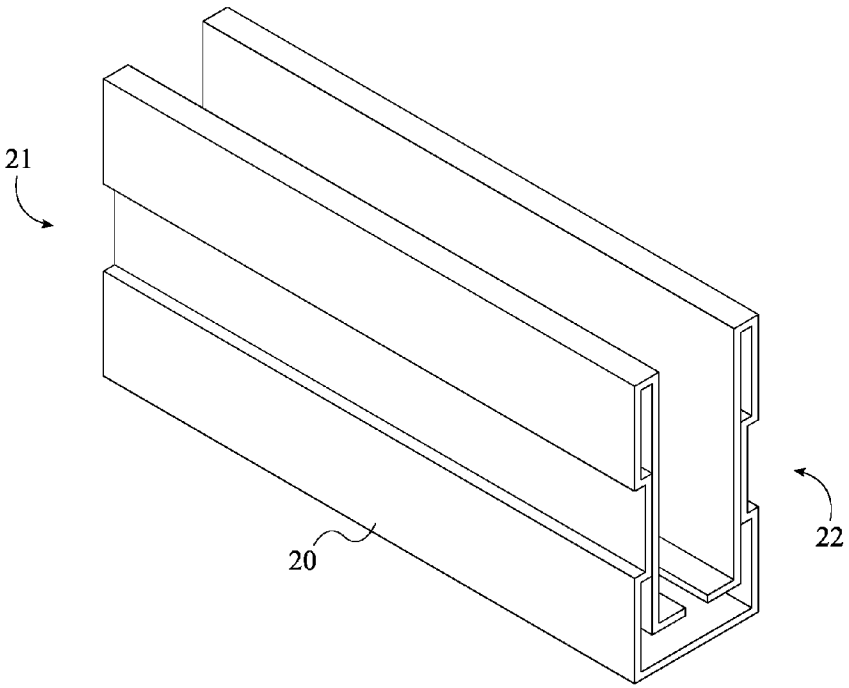
FIG. 3 is a perspective view of one of the plurality of couplers.

In reference to FIG. 3, each of the plurality of couplers 2 comprises a coupler body 20, a first mating channel 21, and a second mating channel 22. The coupler body 20 is an elongated member that is positioned within the coupler receiving volume 14 of adjacent support beams in order to join the support beams together, while simultaneously structurally reinforcing the support beams. Similar to the beam body 10, in the preferred embodiment of the present invention, the coupler body 20 of each of the plurality of couplers 2 is roll formed from steel, however, different materials and methods of formation may be used in other embodiments.

Figure 4:
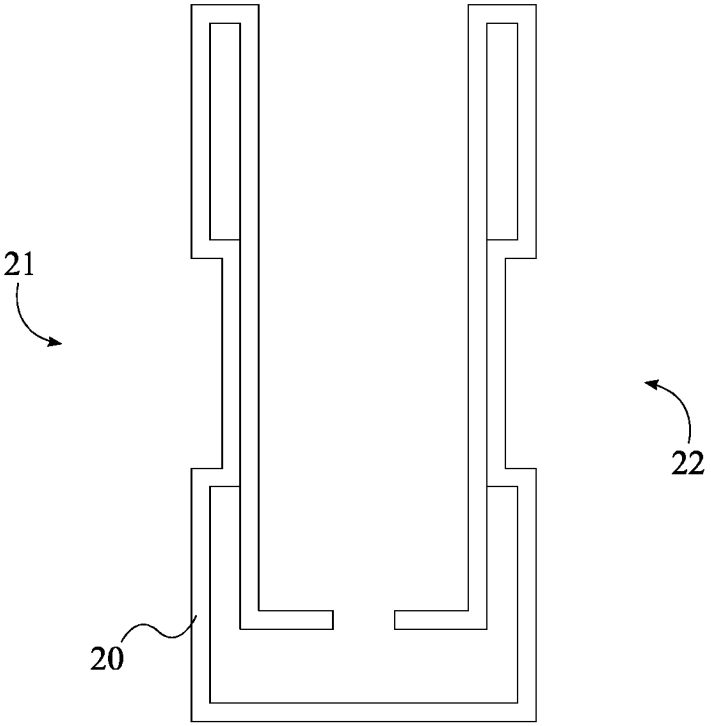
FIG. 4 is a right side elevational view thereof.

In reference to FIG. 4, the first mating channel 21 and the second mating channel 22 are formed into the coupler body 20, wherein the first mating channel 21 and the second mating channel 22 are positioned opposite each other across the coupler body 20. The first mating channel 21 corresponds to the first structural channel 11, while the second mating channel 22 corresponds to the second structural channel 12. As such, the first mating channel 21 and the second mating channel 22 provide a juncture with the first structural channel 11 and the second structural channel 12 respectively, for installing the plurality of fasteners 4.

In further reference to FIG. 4, similar to the beam body 10, the coupler body 20 has a U-shaped cross section. The outer profile of the coupler body 20 is designed to fit snuggly within the inner profile of the beam body 10 (i.e. the coupler receiving volume 14). The snug fit of the coupler body 20 within the coupler receiving volume 14 ensures the secure connection of support beams, such that lateral movement of the support beams is barred. Furthermore, the coupler body 20 provides added strength to reinforce the juncture between support beams.

In order to terminally connect a first support beam 16 from the plurality of support beams 1 to a second support beam 17 from the plurality of support beams 1, an arbitrary coupler 23 from the plurality of couplers 2 is selected. In reference to FIG. 7-8, the arbitrary coupler 23 is positioned into the coupler receiving volume 14 of the first support beam 16 and the coupler receiving volume 14 of the second support beam 17, wherein the end of the first support beam 16 is positioned flush against the end of the second support beam 17; the first support beam 16 being parallel to the second support beam 17. The arbitrary coupler 23 is secured in place using the plurality of fasteners 4; the plurality of fasteners 4 being engaged with the arbitrary coupler 23 through the first support beam 16 and the second support beam 17.

Figure 7:
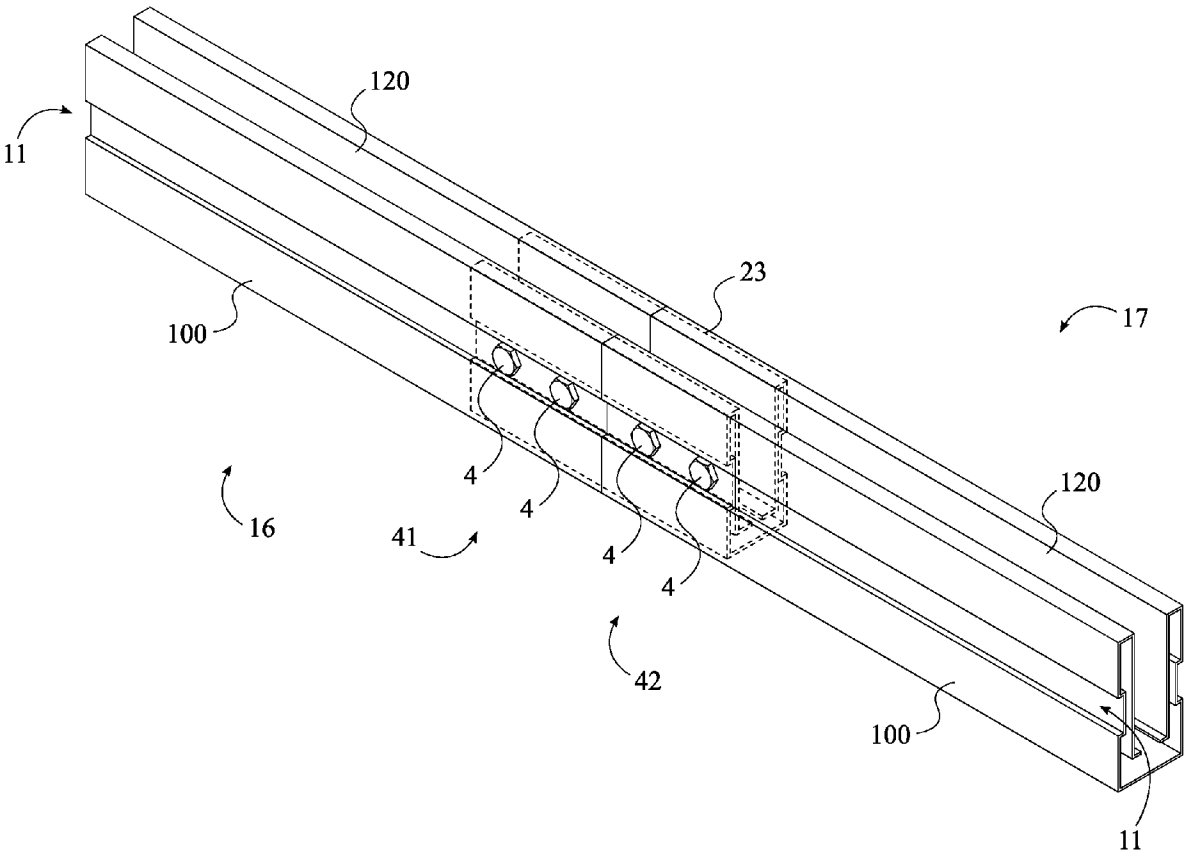
FIG. 7 is a perspective view, wherein an arbitrary coupler is positioned into the coupler receiving volume of both a first support beam and a second support beam; the plurality of fasteners being aligned within the first structural channel of both the first support beam and the second support beam.
Figure 8:
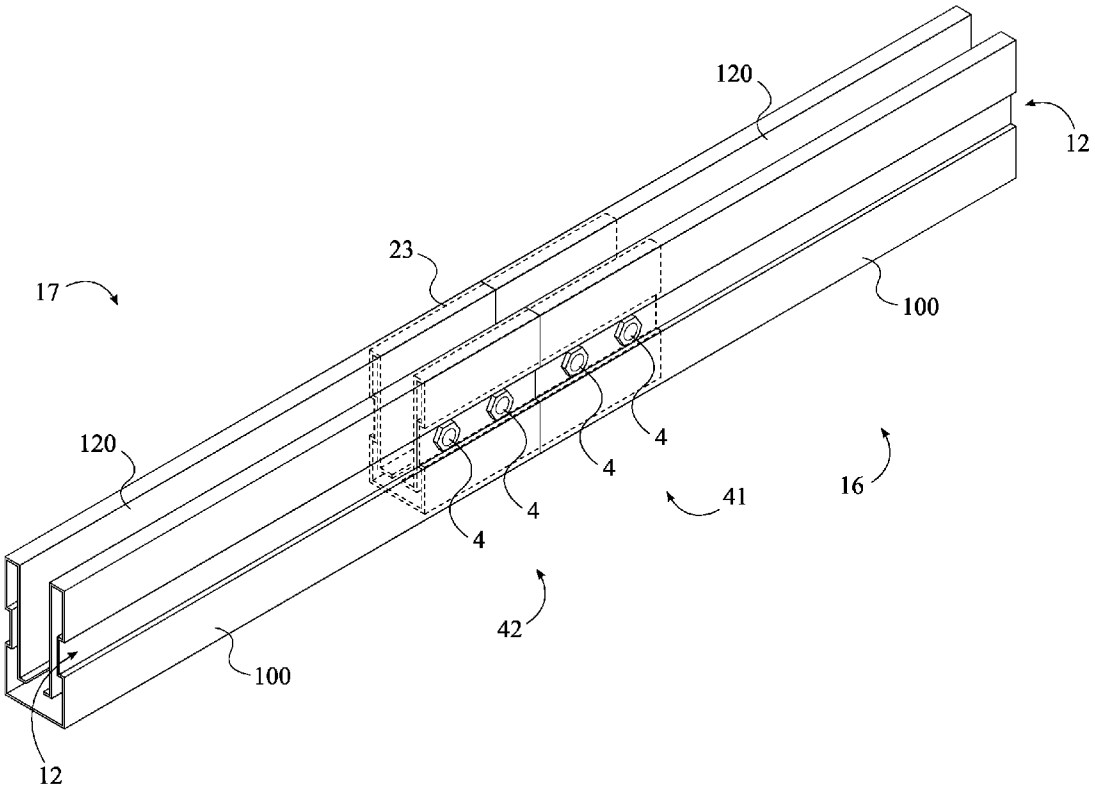
FIG. 8 is a rear perspective view thereof, depicting the plurality of fasteners aligned within the second structural channel of both the first support beam and the second support beam.

In further reference to FIG. 7-8, a first set of fasteners 41 from the plurality of fasteners 4 is inserted through the first support beam 16 into the arbitrary coupler 23, while a second set of fasteners 42 from the plurality of fasteners 4 is inserted through the second support beam 17 into the arbitrary coupler 23. The plurality of fasteners 4 can be inserted from either side of the first support beam 16 and the second support beam 17 in order to secure the arbitrary coupler 23 to the first support beam 16 and the second support beam 17. Each of the plurality of fasteners 4 may traverse partially or fully through the beam body 10 of the first support beam 16 and the beam body 10 of the second support beam 17.

In order to connect the first support beam 16 to the second support beam 17 at an angle, an arbitrary spline 30 from the plurality of splines 3 is selected. In reference to FIG. 9-10, the first support beam 16 and the second support beam 17 are positioned at the desired angle, and the arbitrary spline 30 is positioned into the spline receiving volume 15 of the first support beam 16 and the spline receiving volume 15 of the second support beam 17. The arbitrary spline 30 is secured in place using the plurality of fasteners 4; the plurality of fasteners 4 being engaged with the arbitrary spline 30 through the first support beam 16 and the second support beam 17.

Figure 9:
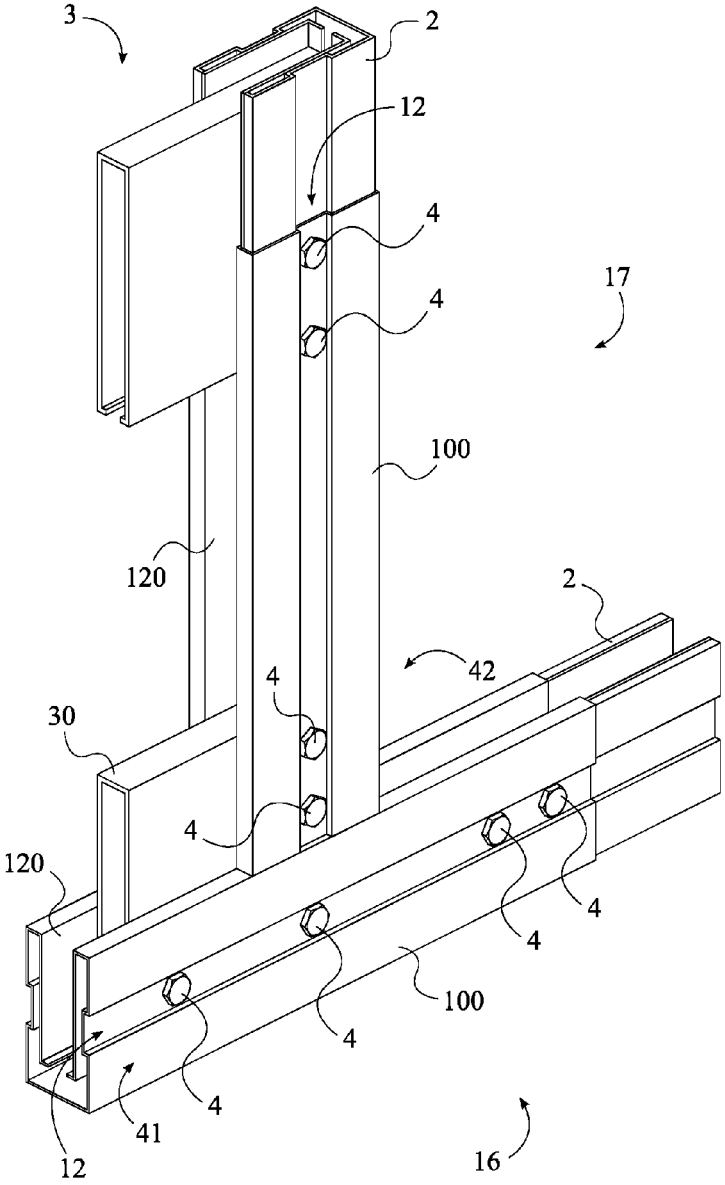
FIG. 9 is a perspective view, wherein an arbitrary spline is positioned into the spline receiving volume of both a first support beam and a second support beam; the plurality of fasteners being aligned within the first structural channel of both the first support beam and the second support beam.
Figure 10:
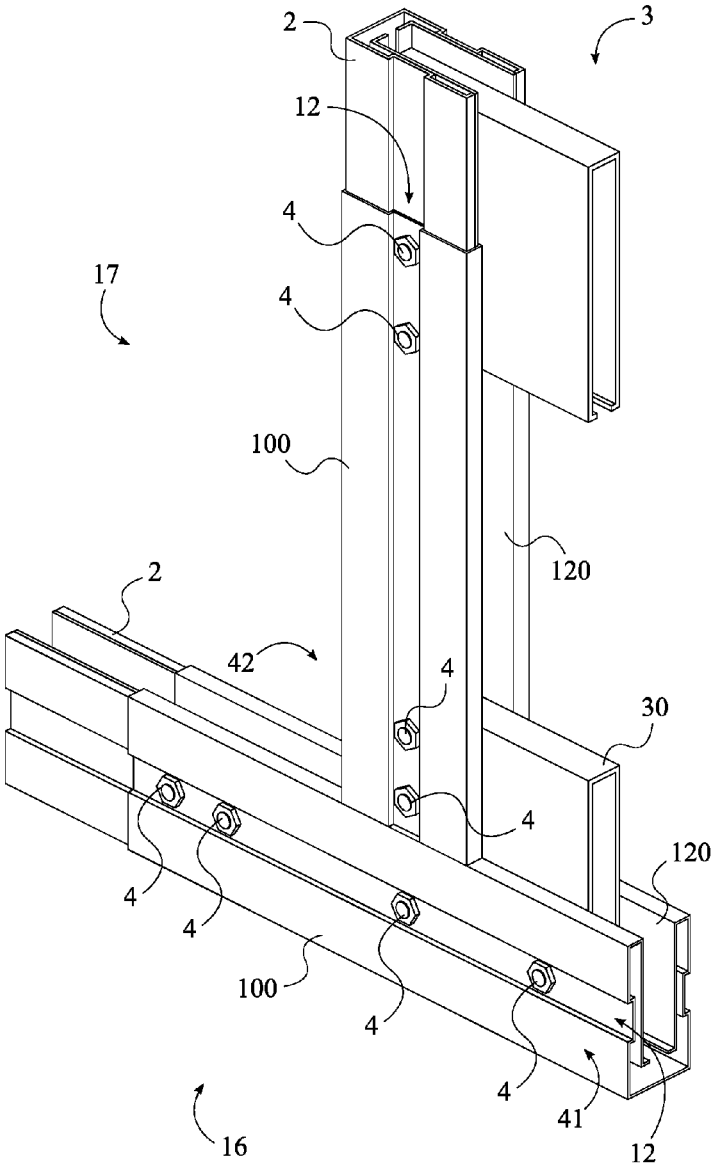
FIG. 10 is a rear perspective view thereof, depicting the plurality of fasteners aligned within the second structural channel of both the first support beam and the second support beam.

In further reference to FIG. 9-10, a first set of fasteners 41 from the plurality of fasteners 4 is inserted through the first support beam 16 into the arbitrary spline 30, while a second set of fasteners 42 from the plurality of fasteners 4 is inserted through the second support beam 17 into the arbitrary spline 30. The plurality of fasteners 4 can be inserted from either side of the first support beam 16 and the second support beam 17 in order to secure the arbitrary spline 30 to the first support beam 16 and the second support beam 17. Each of the plurality of fasteners 4 may traverse partially or fully through the beam body 10 of the first support beam 16 and the beam body 10 of the second support beam 17.

When securing the arbitrary coupler 23 or the arbitrary spline 30 in place, the plurality of fasteners 4 is aligned within the first structural channel 11 and/or the second structural channel 12 of both the first support beam 16 and the second support beam 17. The first structural channel 11 and the second structural channel 12 allow the plurality of fasteners 4 to be recessed with respect to the outer profile of the beam body 10. In this way, other support beams, assemblies, materials, etc. may be positioned flush against the plurality of support beams 1 without interference from the plurality of fasteners 4.

Depending on the type of fasteners used, holes may need to be formed through the first support beam 16, the second support beam 17, and the arbitrary coupler 23 or the arbitrary spline 30. For instance, if each of the plurality of fasteners 4 is a bolt, then a hole must be provided for each of the plurality of fasteners 4, wherein each of the plurality of fasteners 4 is positioned through the support beam and the arbitrary coupler 23 or the arbitrary spline 30, and secured in place using a nut. In other embodiments, each of the plurality of fasteners 4 is self-tapping, such that either no holes are needed or such that smaller diameter holes can be provided.

Figure 11:
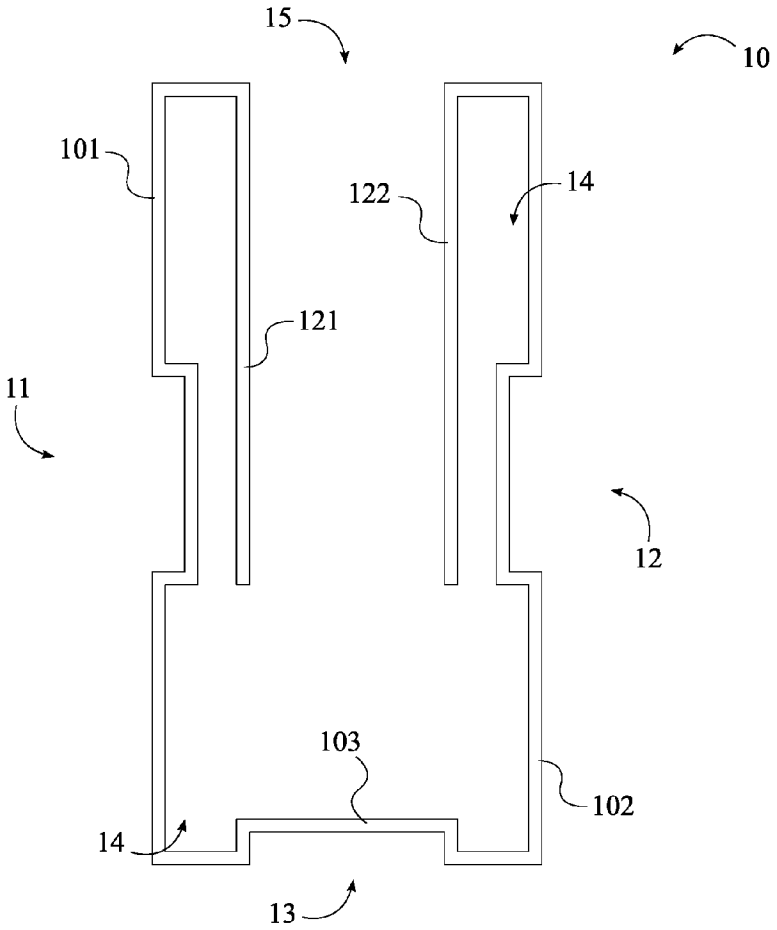
FIG. 11 is a right side elevational view of one of the plurality of support beams having a third structural channel.

In reference to FIG. 11, in some embodiments of the present invention, each of the plurality of support beams 1 further comprises a third structural channel 13. Similar to the first structural channel 11 and the second structural channel 12, the third structural channel 13 is formed into the outer lateral wall 100; the third structural channel 13 being positioned perpendicular to the first structural channel 11 and the second structural channel 12. The third structural channel 13 allows for the use of the plurality of fasteners 4 along the third outer-lateral wall 103, in order to further secure the arbitrary coupler 23 or the arbitrary spline 30 to one of the plurality of support beams 1.

Although the invention has been explained in relation to its preferred embodiment, it is to be understood that many other possible modifications and variations can be made without departing from the spirit and scope of the invention as hereinafter claimed.

What is claimed is:

1. A roll form framing system comprising:

a plurality of support beams;

a plurality of couplers;

a plurality of splines;

each of the plurality of support beams comprising a beam body, a first structural channel and a second structural channel;

the beam body comprising an outer lateral wall and an inner lateral wall;

the outer lateral wall comprising a first outer-lateral wall, a second outer-lateral wall and a third outer-lateral wall;

the first outer-lateral wall and the second outer-lateral wall being terminally connected to the third outer-lateral wall;

the first outer-lateral wall, the second outer-lateral wall and the third outer-lateral wall forming a U-shape;

the first outer-lateral wall and the second outer-lateral wall being positioned parallel to each other;

the first outer-lateral wall and the second outer-lateral wall each being positioned perpendicular to the third outer-lateral wall;

the inner lateral wall comprising a first inner-lateral wall and a second inner-lateral wall;

the first inner-lateral wall and the second inner-lateral wall being positioned parallel to each other;

the first inner-lateral wall and the second inner-lateral wall being positioned in between the first outer-lateral wall and the second outer-lateral wall;

the first inner-lateral wall and the second inner-lateral wall each being extended adjacent to the third outer-lateral wall;

the first structural channel being formed into the first outer-lateral wall;

the second structural channel being formed into the second outer-lateral wall;

the first structural channel and the second structural channel being positioned opposite each other across the beam body;

the first outer-lateral wall, the second outer-lateral wall, the third outer-lateral wall, the first inner-lateral wall and the second inner-lateral wall delineating a coupler receiving volume for accepting one of the plurality of couplers;

the first inner-lateral wall and the second inner-lateral wall delineating a spline receiving volume for accepting one of the plurality of splines;

the spline receiving volume and the first structural channel being separate from each other via the first inner-lateral wall; and the spline receiving volume and the second structural channel being separate from each other via the second inner-lateral wall.

2. The roll form framing system as claimed in claim 1 comprising:

each of the plurality of couplers comprising a coupler body, a first mating channel and a second mating channel;

the first mating channel and the second mating channel being formed into the coupler body; and the first mating channel and the second mating channel being positioned opposite each other across the coupler body.

3. The roll form framing system as claimed in claim 2 comprising:

the first mating channel corresponding to the first structural channel; and the second mating channel corresponding to the second structural channel.

4. The roll form framing system as claimed in claim 1 comprising:

each of the plurality of support beams comprising a third structural channel;

the third structural channel being formed into the third outer-lateral wall; and the third structural channel being positioned perpendicular to the first structural channel and the second structural channel.

5. The roll form framing system as claimed in claim 1 comprising:

an arbitrary coupler from the plurality of couplers being positioned into the coupler receiving volume of a first support beam from the plurality of support beams; and the arbitrary coupler from the plurality of couplers being positioned into the coupler receiving volume of a second support beam from the plurality of support beams.

6. The roll form framing system as claimed in claim 5 comprising:

a plurality of fasteners; and the plurality of fasteners being engaged with the arbitrary coupler through the first support beam and the second support beam.

7. The roll form framing system as claimed in claim 6 comprising:

the plurality of fasteners being aligned within the first structural channel of both the first support beam and the second support beam.

8. The roll form framing system as claimed in claim 6 comprising:

the plurality of fasteners being aligned within the second structural channel of both the first support beam and the second support beam.

9. The roll form framing system as claimed in claim 6, wherein each of the plurality of fasteners is self-tapping.

10. The roll form framing system as claimed in claim 5 comprising:

the first support beam being parallel to the second support beam.

11. The roll form framing system as claimed in claim 1 comprising:

an arbitrary spline from the plurality of splines being positioned into the spline receiving volume of a first support beam from the plurality of support beams; and the arbitrary spline from the plurality of splines being positioned into the spline receiving volume of a second support beam from the plurality of support beams.

12. The roll form framing system as claimed in claim 11 comprising:

a plurality of fasteners; and the plurality of fasteners being engaged with the arbitrary spline through the first support beam and the second support beam.

13. The roll form framing system as claimed in claim 12 comprising:

the plurality of fasteners being aligned within the first structural channel of both the first support beam and the second support beam.

14. The roll form framing system as claimed in claim 12 comprising:

the plurality of fasteners being aligned within the second structural channel of both the first support beam and the second support beam.

15. The roll form framing system as claimed in claim 12, wherein each of the plurality of fasteners is self-tapping.

* * * * *